United States Patent [19]

Reppen

[11] Patent Number: 4,887,838

[45] Date of Patent: Dec. 19, 1989

[54] WHEELED CARRIER FOR A SNOW PLOW

[76] Inventor: William D. Reppen, 6860 Heather Heath La., West Bloomfield, Mich. 48322

[21] Appl. No.: 188,818

[22] Filed: May 2, 1988

[51] Int. Cl.[4] ..... B62B 5/00

[52] U.S. Cl. ..... 280/656; 254/7 R; 254/102; 414/589

[58] Field of Search ..... 254/7 R, 7 B, 7 C, 102; 414/589, 590; 37/231; 172/272, 275; 280/79.1 A, 656, 477, 478 R, 79.11

[56] References Cited

U.S. PATENT DOCUMENTS

| | | | |
|---|---|---|---|
| 1,280,472 | 10/1918 | Hopkins | 254/8 B |
| 1,559,098 | 10/1925 | Hopkins | 254/7 B |
| 1,559,391 | 10/1925 | Waters | 254/7 B |
| 1,740,299 | 12/1929 | Henkle | 254/7 B |
| 2,613,083 | 10/1952 | Moludy | 280/42 |
| 2,706,881 | 4/1955 | McDonald | 280/656 X |
| 2,801,861 | 8/1957 | HAnson | 280/43.2 |
| 3,941,400 | 3/1976 | Buttner | 280/79.1 A |
| 4,205,825 | 6/1980 | Stanford | 254/420 |
| 4,572,531 | 2/1986 | Elia | 280/79.1 A X |
| 4,596,290 | 6/1986 | Bedney | 280/656 X |

*Primary Examiner*—Charles A. Marmor
*Assistant Examiner*—Michael Mar
*Attorney, Agent, or Firm*—Alex Rhodes

[57] ABSTRACT

A wheeled carrier apparatus for attaching and removing a demountable snow plow from a motor vehicle comprising a planar assembly of slender members which is adjustable forwarding to an open operative configuration and rearwardly to a closed shipping and storage configuration, a singular elevating structure pivotally mounted on the base structure and a singular jackscrew for raising and lowering the elevating structure. The base structure has a multi-piece slender front lateral rail, a slender rear lateral rail, a pair of slender side rails which pivotally interconnect the outer end portions of the front rail with the outer end portions of the rear rail, a first locking pin for securing the planar assembly of slender members in the open operative configuration, and a second locking pin for securing the planar assembly of slender members in the closed shipping and storage configuration. A plurality of wheels are mounted on the underside of the base structure which cooperate with the elevating structure to align the snow plow's attaching members with the vehicle's attaching members.

11 Claims, 3 Drawing Sheets

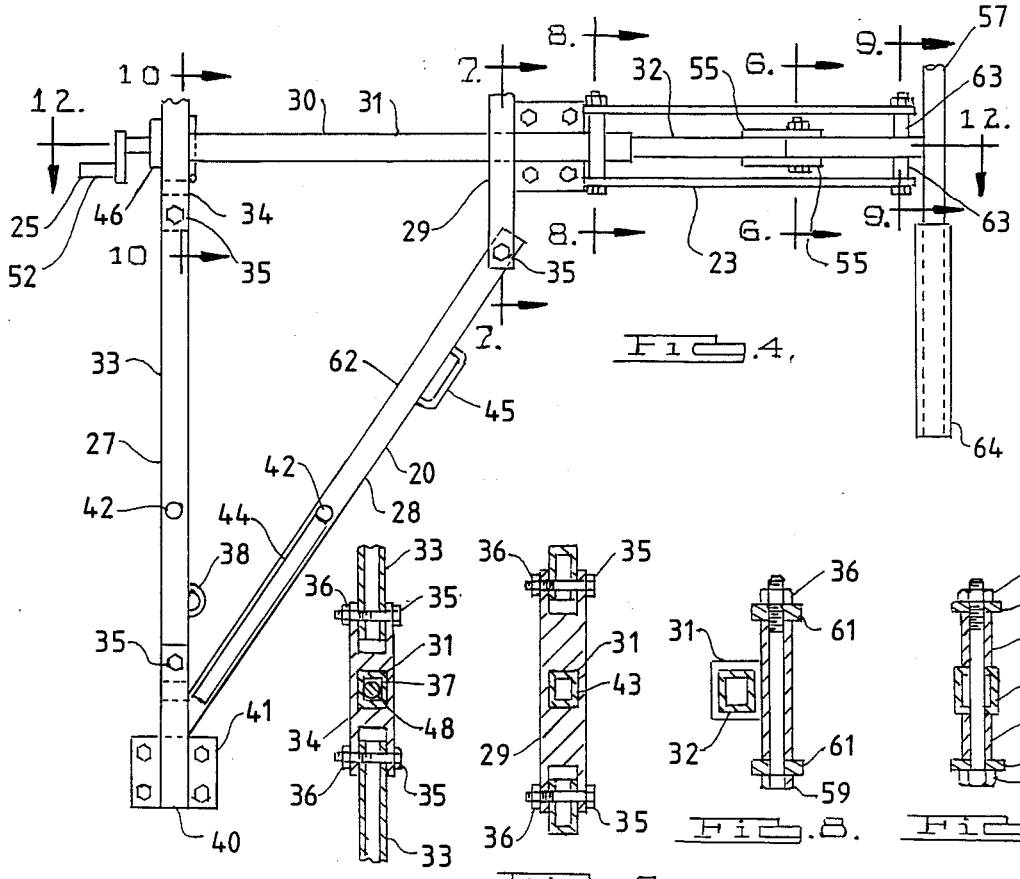
Fig. 4.
Fig. 7.
Fig. 8.
Fig. 9.
Fig. 10.
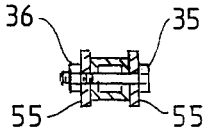
Fig. 6.
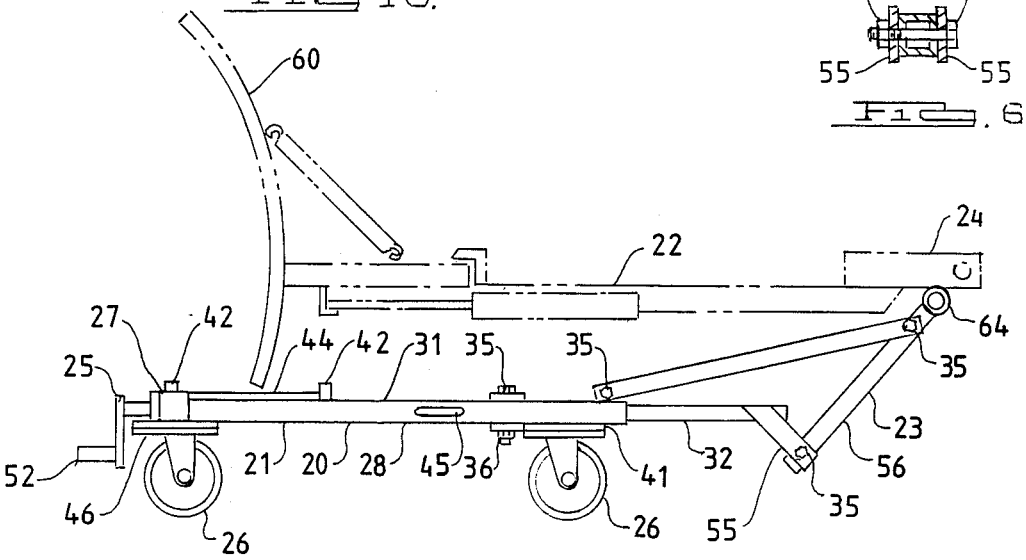
Fig. 5.

WHEELED CARRIER FOR A SNOW PLOW

BACKGROUND OF THE INVENTION

This invention relates to carriers for motor vehicle snow plows and in particular to a wheeled carrier for installing, removing and storing a motor vehicle snow plow.

Motor vehicle snow plows are large devices with power lift means weighing several hundred pounds. Installations require the precise alignment of brackets and arms to vehicle members attached to vehicle bumpers and chassis structures. Heretofore, snow plows have been difficult to move and to align with vehicle attaching members during their installation and removal from motor vehicles.

Moreover, installations have required more than one person, have relied on trial and error, have been time-consuming and have required high manual efforts to lift and align plow members with corresponding vehicle members. At the end of a winter season, when plows are removed from service and stored until the following winter, specific devices have been unavailable for handling and moving the large heavy plows to storage areas.

SUMMARY OF THE INVENTION

The present invention is a lightweight portable carrier for transporting, installing, removing and storing a vehicle mounted snow plow. These ends are accomplished by a steerable wheeled carrier which is adapted for supporting a snow plow and which has means for raising and lowering the plow's attaching members to vertically align them with the vehicle's corresponding members.

The invention comprises a planar base structure mounted on caster wheels, an elevating structure mounted on the base structure and a means for raising and lowering the elevating structure.

It is a primary object of the invention to provide an easy to use and effective portable apparatus for mounting and de-mounting snow plows from motor vehicles.

It is another object, in addition to the foregoing object, to reduce the time and manual effort which are required to install and remove a snow plow from a motor vehicle.

It is another object in addition to the foregoing objects, to provide an apparatus for attaching and removing a snow plow from a vehicle which is adaptable to a range of existing snow plow sizes.

It is another object, in addition to the foregoing objects to provide an apparatus for transporting snow plows to and from storage areas.

It is another object, in addition to the foregoing objects to provide a snow plow carrier which can be folded into a compact configuration for shipping and storage when the carrier is not in use.

Additional objects, features and benefits will be apparent from the ensuing description and accompanying drawings which describe the invention in detail. A preferred embodiment and the use of the same are disclosed according to the best mode contemplated in practicing the invention and the subject matter in which exclusive property rights are claimed is set forth in each of the numbered claims at the conclusion of the detailed description.

BRIEF DESCRIPTION OF THE DRAWINGS

FIG. 4 is a fragmentary plan view of the carrier drawn to an enlarged scale.

FIG. 5 is a left side elevational view of the carrier drawn to an enlarged scale over FIG. 1 with a snow plow shown in phantom mounted on the carrier.

FIG. 6 is a cross-sectional view taken on the line 6—6 of FIG. 4.

FIG. 7 is a cross-sectional view taken on the line 7—7 of FIG. 4.

FIG. 8 is a cross-sectional view taken on the line 8—8 of FIG. 4.

FIG. 9 is a cross-sectional view taken on the line 9—9 of FIG. 4.

FIG. 10 is a cross-sectional view taken on the line 10—10 of FIG. 4.

DETAILED DESCRIPTION OF THE PREFERRED EMBODIMENT

Figure 1:
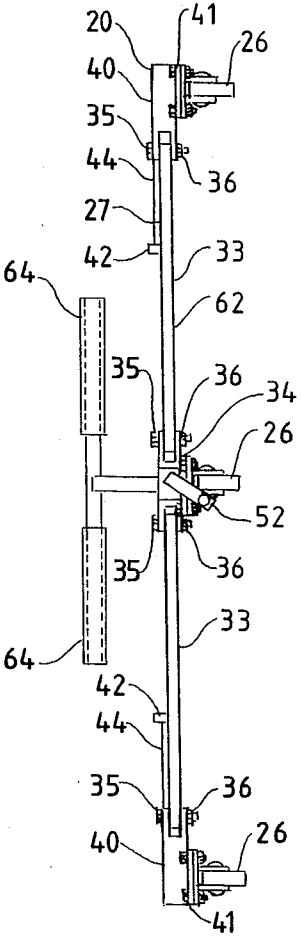
FIG. 1 is a front elevational view of a wheeled carrier for mounting a snow plow on a motor vehicle constructed in accordance with the present invention.

Referring now to the drawings, wherein like numerals designate like and corresponding parts throughout the several views, in the particular embodiment 20 of the present invention which is shown therein for illustrative purposes, the carrier comprises a trapezoidal base structure 21 for supporting a snow plow 22; an elevating structure 23 mounted on the base structure 21 for raising and lowering the plow's members 24 which attach the plow 20 to a motor vehicle (not shown); a means 25 for raising and lowering the elevating structure 23 and caster wheels 26 mounted to the underside of the base structure 21 for transporting and aligning the plow 22 with a vehicle.

One feature of the invention is that it can be folded into a compact configuration for shipping and storage. Another feature is that it can be used with a range of snow plow sizes.

Figure 2:
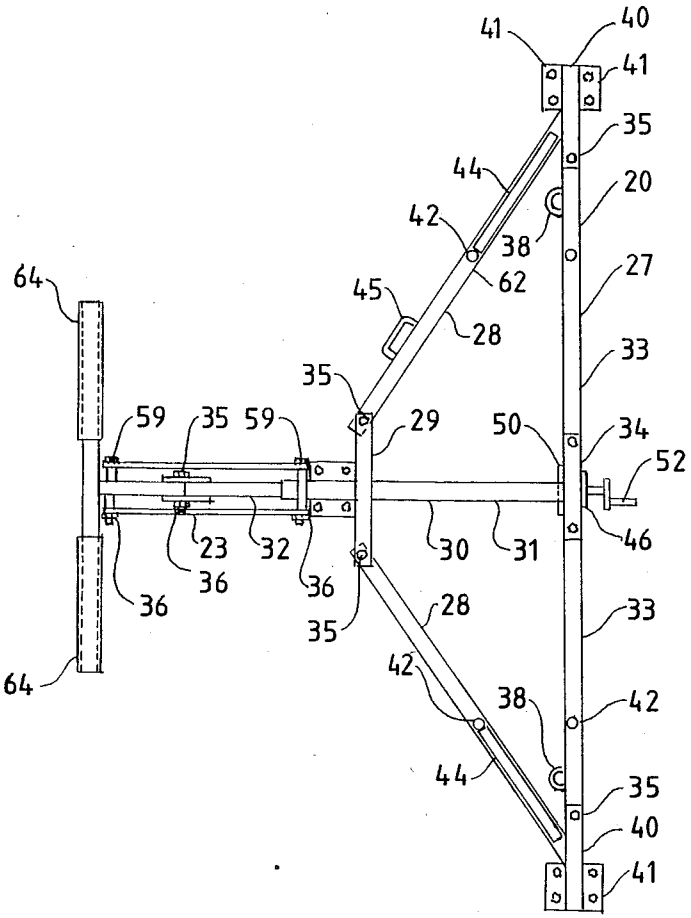
FIG. 2 is a plan view of the carrier shown in FIG. 1.
Figure 11:
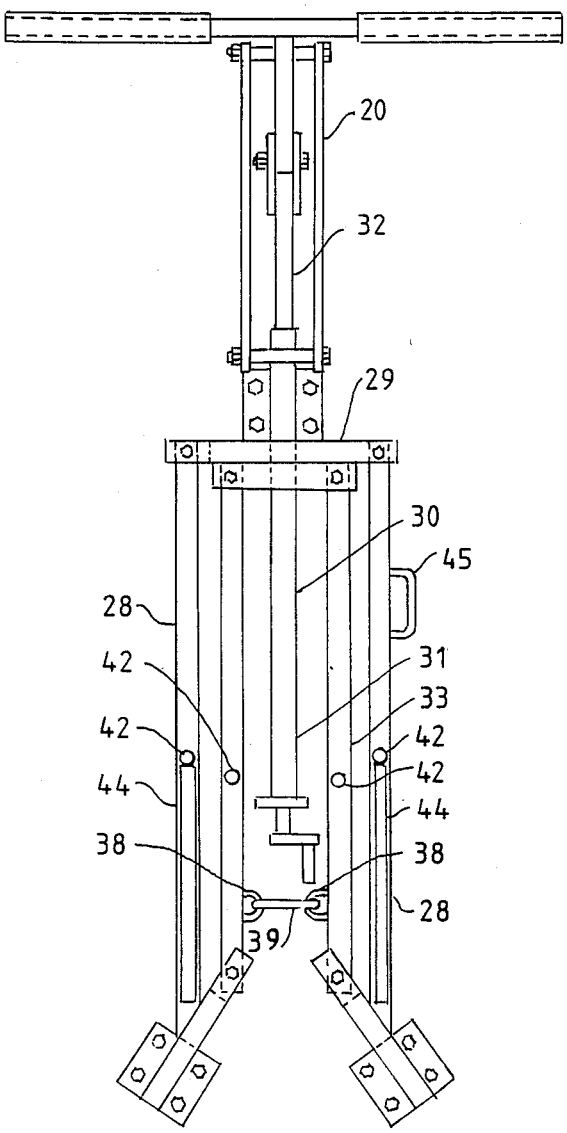
FIG. 11 is a plan view of the carrier shown in FIG. 1 in a compact folded arrangement for shipping and storage.

With reference to FIGS. 1 and 2, the base structure 21 is a planar structure which is adjustable to an open operating configuration shown in FIG. 2 and to a compact closed shipping and storing position shown in FIG. 11. The base structure 21 has a lateral multi-piece front rail 27, a lateral rear rail 29 which is shorter in length than the front rail 27 and in spaced apart parallel relationship to the front rail 27; a pair of angularly disposed side rails 28 which interconnect outer end portions of the front rail 27 and outer end portions of the rear rail 29; and a multi-piece longitudinal center rail 30.

The construction of the front rail 27 is shown in FIGS. 1, 2 and 10. The front rail 27 is an assembly of two slender rectangular tubular outer members 33, interconnected by a short center coupling 34, and has a pair of rectangular tubular extensions 40 which are rotatably attached to the outer end portions of the front rail outer members 33. At the center of the coupling 34 there is a rectangular aperture 37 for slideably mounting the front rail coupling 34 on the center rail 30. On the inner vertical surface of each of the front rail outer members 33 there is an eye 38 fixedly attached for connecting the outer members 33 to each other when the carrier 20 is folded into the compact shipping and storage configuration shown in FIG. 11.

The outer end portions of the front rail center coupling 34 are recessed and receive the inner end portions of the front rail outer members 33 which are rotatably attached to the coupling 34 with pivot bolts 35 and nuts 36. The inner end portions of the front rail extensions 40 are likewise recessed and receive the outer end portions of the front rail outer members 33 which likewise rotatably attach to the rail extensions 40 with pivot bolts 35 and nuts 36. Fixedly attached to the underside of the outer end portions of the front rail extensions 40 are rectangular plates 41 to which a pair of caster wheels 26 are attached.

The construction of the rear rail 29 is shown in FIGS. 1, 4, and 7. The rear rail 29 is a slender rectangular member with a rectangular aperture 43 through which the center rail front member 31 extends and at which the center rail front member 31 is fixedly attached. The end portions of the rear rail 29 are recessed and receive the rear end portions of the side rails 28 which rotatably attach to the rear rail 29 with pivot bolts 35 and nuts 36.

On the top surfaces of the side rails 28 a pair of rub strips 44 are adhesively attached to prevent damage to the finish of the side rails 28 and to the edges of a snow plow blade 60 which is supported by the carrier 20. Fixedly attached to the side rails 28 adjacent to the forward outer end of each rub strip 44 and on the front rail outer members 33 are cylindrical retaining posts 42. Attached to the outer surface of the left side rail 62 there is a "U"-handle 45 fixedly attached for carrying the device 20 in the folded configuration shown in FIG. 11.

Referring now to FIGS. 4 and 5, the center rail 30 has a fixed slender rectangular tubular front center rail member 31 and a slender moveable rectangular tubular rear member 32 which telescopingly engages the fixed center rail front member 31. A lateral rectangular plate 46 is fixedly mounted to the forward end of the center rail front member 31 and has a slightly greater width than the center rail front member 31. The plate 46 has an aperture 47 which receives and supports the forward end of a rotatable jackscrew 48.

Figure 3:
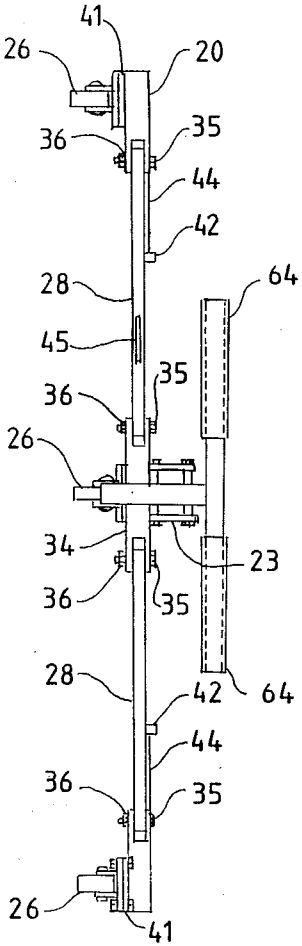
FIG. 3 is a left side elevational view of the carrier.

Slightly rearward of the plate 46, there is a pair of transverse apertures 49 which extend through the center rail front member 31 and receive an L-shaped locking pin 50. The loeking pin 50 cooperates with the plate 46 to secure the carrier 20 in the open operative configuration depicted in FIGS. 1 thru 3. At the rearward end of the center rail front member 31 there is a rectangular plate 41 with a caster wheel 26 attached.

Figure 12:
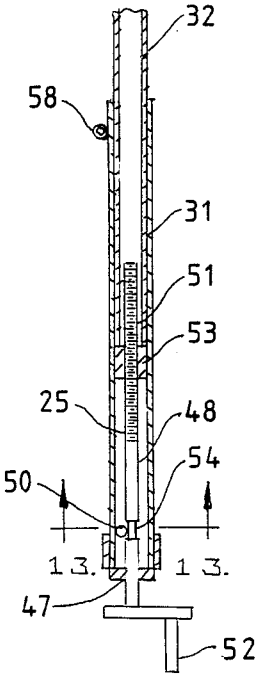
FIG. 12 is a cross-sectional view taken on the line 12—12 of FIG. 4.
Figure 13:
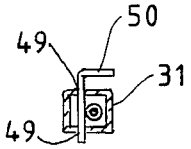
FIG. 13 is a cross-sectional view taken on the line 13—13 of FIG. 12.

The construction of the jackscrew 48 for raising and lowering the elevating structure 43 is shown in FIG. 12. The jackscrew 48 is a slender round member with a threaded rear portion 51 and a front end portion which projects outwardly from the front rail 27. A crank handle 52 is fixedly attached to the front end of the jackscrew 48 for rotating the jackscrew 48 to raise and lower the elevating structure 23. The threaded portion 51 engages a nut 53 which is inside of the center rail fixed member and fixedly attached to the forward end portion of the center rail moveable member 37. At the forward end portion of the jackscrew 48 there is a groove 54 for clearing the L-shaped locking pin 50 which extends laterally through the fixed center rail front member 31.

Referring now to FIG. 5, the elevating structure comprises a pair of arms 55 which are fixedly attached to the telescoping member 32 and angle downwardly and forwardly; a slender rectangular tubular center link 56 which is rotatably attached with a pivot bolt 35 and nut 36 to the arms 55 and angles forwardly and upwardly and; a pair of spaced apart parallel side links 61 which are rotatably attached to a tubular spacer 58 fixedly mounted to the fixed center member 31 with a pivot bolt 59 and nut 36 and angle forwardly and upwardly to rotatably attach with a pivot bolt 59 and nut 36 and a pair of tubular spacers 63 to the center link 56; and a cross-bar 57 fixedly mounted to the upper end of the center link 56. At each end of the cross-bar 57 there is preferably a tubular rubber sleeve 64 for preventing damage to the cross-bar 57 from the plow members 24 supported by the cross-bar 57.

The manner of using the carrier 20 is as follows. With reference to FIG. 5, a snow plow 22 is mounted on the carrier 20 with the lower edge of the snow plow blade 61 overhanging the side rails 28, resting on the rub strips 44 between the cylindrical retaining posts 42. The attaching member, i.e., the tow bar 24 of the plow 22 overhangs and rests on the tubular sleeves 64 of the cross-bar 57. It will be observed that the angular side rails 28 form a variable width platform structure which can support a range of snow blade widths and snow plow lengths.

The carrier 20 is moved into position and the tow bar 24 is angularly aligned with a corresponding attaching member of the motor vehicle (not shown). The tow bar 24 is then vertically aligned with the vehicle attaching member by rotating the crank handle 52 to raise or lower the elevating structure 23.

With reference to FIGS. 5 and 12, clockwise rotation of a right hand threaded jackscrew 48 by the crank handle 52 will retract the center rail telescopic member 32 into the fixed center rail front member 31 and lower the cross-bar 57 to raise the tow-bar 24. Likewise, a counterclockwise rotation of the jackscrew will elevate the tow-bar 24.

After the tow-bar 24 and other plow members are connected to the corresponding vehicle members, the plow 20 is raised with its power lift means and the carrier 20 is withdrawn from the plow 22. When it is necessary to remove the plow 22 from the vehicle, the foregoing steps are repeated in reverse order. For shipping and storage, the L-shaped pin 50 is withdrawn from the center rail 30 and the carrier 20 is folded into the compact configuration shown in FIG. 9 by pivoting the front rail outer members 33 about their pivot bolt 35 attachments to the center coupling 34 and the rail extensions 40 and the eyes 38 are interconnected with the clasp 39.

From the foregoing, it will be appreciated that the present invention provides an effective, easy to use apparatus for aligning and attaching a snow plow to a motor vehicle and for storing the plow when it is removed from service.

Although but a single embodiment has been illustrated and described it will be further appreciated that other embodiments can be derived my changes in the material, size, shape and substitution and arrangement of parts without departing from the spirit thereof.

I claim:

1. A carrier apparatus for a demountable motor vehicle snow plow, comprising, in combination: a base structure having a pair of side rails adapted to support the blade of a snow plow of the type having an arcuate transverse blade and members attached to the rear of said blade for attaching said blade to a vehicle, a plurality of wheels mounted on the underside of said base structure for transporting and aligning the attaching members of the plow with the attaching members of a motor vehicle; an elevating structure attached to said base structure, said elevating structure being adapted for raising and lowering the attaching members of the plow and cooperating with said wheels to support and align the attaching members of the plow with the attaching members of said motor vehicle; and a singular jackscrew means for raising and lowering said elevating structure, said jackscrew means comprising an extensible member having a fixed member fixedly attached to said base structure, a moveable member telescopingly engaging and projecting outwardly from said fixed member, and a jackscrew attached to said fixed member and operatively engaging said moveable member for selectively urging said moveable member inwardly and outwardly from said fixed member to raise or lower said elevating structure.

2. The snow plow carrier recite din claim 1 wherein said base structure is a planar assembly of slender members, comprising a slender front lateral rail, a slender rear lateral rail; said pair of side rails interconnecting said front rail with said rear rail.

3. The snow plow carrier recited in claim 2 wherein the length of said rear rail is less than the length of said front rail.

4. The snow plow carrier recited in claim 1 wherein said base structure is a foldable planar assembly of slender members which is selectively unfoldable to an open operative configuration and foldable rearwardly to a closed shipping and storage configuration, comprising a multipiece slender front lateral rail, said front rail having a short center coupling; and an outer member pivotally connected at the inner end portion to each outer end portion of said front rail center member; a slender rear lateral rail; said pair of side rails pivotally interconnecting the outer end portions of said front rail with the outer end portions of said rear rail, said side rails and said outer members of said rear rail being rotatable inwardly from said open operative configuration to said foldable closed stored configuration; a means for securing said base structure in said open operative configuration; and a means for securing said base structure in said closed shipping and storage configuration.

5. The snow plow carrier recited in claim 4 wherein said means for securing said base structure in said open operative configuration comprises said center rail having a pair of apertures directly behind said front rail and a removable L-shaped pin extending through said apertures.

6. The snow plow carrier recited in claim 4 wherein said means for securing said base structure in said closed shipping and storage configuration comprises an eye fixedly attached to the inner surface of said side rails and a clasp for interconnecting said eyes.

7. A carrier apparatus for a demountable motor vehicle snow plow, comprising, in combination: a base structure adapted to support a snow plow, a plurality of wheels mounted on the underside of said base structure for transporting and aligning the attaching members of the plow with the attaching members of a motor vehicle, said base structure being a planar assembly of slender members and comprising a slender front lateral rail, a slender rear lateral rail; and a pair of adjoining slender side rails which interconnect the end portions of said front rail with the end portions of said rear rail; an elevating structure adapted for raising and lowering the attaching members of the plow, said elevating structure cooperating with said wheels to support and align the attaching members of the plow with the attaching members of said motor vehicle and comprising a multi-piece slender rectangular tubular center rail, said center rail having a forward member fixedly attached to said base structure and a moveable rear member telescopingly engaging and projecting rearwardly out of said fixed front member, a means for selectively urging said center rail moveable member inwardly and outwardly from said center rail fixed member; a first link, one end portion of said first link pivotally attached to the rear end portion of said center rail moveable member and extending upwardly and rearwardly from its attachment to said center rail moveable member; a cross-bar fixedly attached to the upper end portion of said first link for supporting the attaching members of a snow plow; and a second link, one end portion of said second link pivotally attached to the rear end portion of said center rail fixed member and the other end portion pivotally attached to the upper end portion of said first link; and a means for raising and lowering said elevating structure.

8. The snow plow apparatus recited in claim 7 wherein said means for urging said moveable center rail raising and lowering said elevating structure comprises: a jackscrew mounted for rotation in the interior of said center rail fixed member and having a front end portion projecting outwardly from the forward end of said center rail fixed member; a crank handle fixedly attached to the forward end portion of said jack screw; and a nut in the interior of said center rail fixed member and fixedly attached to the rearward end portion of said center rail moveable member.

9. A carrier apparatus for a demountable motor vehicle snow plow, comprising, in combination: a base structure adapted to support a snow plow, a plurality of wheels mounted on the underside of said base structure for transporting and aligning the attaching members of the plow with the attaching members of a motor vehicle, said base structure comprising a foldable planar assembly of slender members which is selectively adjustable to an open operative configuration and to a closed shipping and storage configuration, comprising a multipiece slender front lateral rail, said front rail having a short center coupling; and an outer member pivotally connected at the inner end portion to each outer end portion of said front rail center member; a slender rear lateral rail; a pair of slender side rails pivotally interconnecting the outer end portions of said front rail with the outer end portions of said rear rail; a means for securing said base structure in said open operative configuration; and a means for securing said base structure in said closed shipping and storage configuration; a plurality of wheels mounted on the underside of said base structure for transporting and aligning the attaching members of the plow with the attaching members of a motor vehicle; an elevating structure adapted for raising and lowering the attaching members of the plow, said elevating structure cooperating with said wheels to support and align the attaching members of the plow with the attaching members of said motor vehicle; and a means for raising and lowering said elevating structure; said means comprising a multi-piece slender rectangular tubular center rail, said center rail having a forward member slideably connected to said front rail center coupling and fixedly connected to said rear rail and a moveable rear member telescopingly engaging and projecting rearwardly out of said fixed front member; a means for selectively urging said center rail moveable member inwardly and outwardly from said center rail fixed member; a first link, one end portion of said first link pivotally attached to the rear end portion of said center rail moveable member and extending upwardly and rearwardly from its attachment to said center rail moveable member; a cross-bar fixedly attached to the upper end portion of said first link for supporting the attaching members of a snow plow; and a second link, one end portion of said second link pivotally attached to the rear end portion of said center rail fixed member and the other end portion pivotally attached to the upper end portion of said first link.

10. A carrier apparatus for a demountable motor vehicle snow plow, comprising, in combination: a planar assembly of slender members, comprising a slender front lateral rail, a slender rear lateral rail, and a pair of adjoining slender side rails which interconnect the end portions of said front rail with the end portions of said rear rail; a plurality of wheels mounted on the underside of said base structure; a multi-piece slender rectangular tubular center rail, said center rail having a forward member fixedly attached to said base structure and a moveable rear member telescopingly engaging and projecting rearwardly out of said fixed front member; a means for selectively urging said center rail moveable member inwardly and outwardly from said center rail fixed member; a first link, one end portion of said first link pivotally attached to the rear end portion of said center rail moveable member and extending upwardly and rearwardly from its attachment to said center rail moveable member; a cross-bar fixedly attached to the upper end portion of said first link; and a second link, one end portion of said second link pivotally attached to the rear end portion of said center rail fixed member and the other end portion pivotally attached to the upper end portion of said first link.

11. A carrier apparatus for a demountable motor vehicle snow plow, comprising, in combination: a planar assembly of slender members which is selectively adjustable to an open operative configuration and to a closed shipping and storage configuration, comprising a multipiece slender front lateral rail, said front rail having a short center coupling and a pair of outer members pivotally connected at the inner end portions thereof to the outer end portions of said front rail center coupling, a slender rear lateral rail and a pair of slender side rails pivotally interconnecting the outer end portions of said front rail outer members with the outer end portions of said rear rail; a means for securing said planar assembly of slender members in said open operative configuration; a means for securing said planar assembly of slender members in said closed shipping and storage configuration; a plurality of caster wheels mounted on the underside of said base structure; a multi-piece slender rectangular tubular center rail, said center rail having a forward member slideably connected to said front rail center coupling and fixedly connected to said rear rail and a moveable rear member telescopingly engaging and projecting rearwardly out of said fixed front member; a means for selectively urging said center rail moveable member inwardly and outwardly from said center rail fixed member: a first link, one end portion of said first link pivotally attached to the rear end portion of said center rail moveable member and extending upwardly and rearwardly from its attachment to said center rail moveable member; a cross-bar fixedly attached to the upper end portion of said first link; for supporting the attaching members of a snow plow and a second link, one end portion of said second link pivotally attached to the rear end portion of said center rail fixed member and the other end portion pivotally attached to the upper end portion of said first link.

* * * * *